US008574353B2

(12) United States Patent
Nazuka et al.

(10) Patent No.: US 8,574,353 B2
(45) Date of Patent: Nov. 5, 2013

(54) ELECTRIC DUST COLLECTOR

(75) Inventors: Taksuki Nazuka, Tochigi (JP); Kazuhiro Suginami, Tochigi (JP)

(73) Assignee: Furukawa Industrial Machinery Systems Co., Ltd., Tokyo (JP)

( * ) Notice: Subject to any disclaimer, the term of this patent is extended or adjusted under 35 U.S.C. 154(b) by 279 days.

(21) Appl. No.: 13/002,149

(22) PCT Filed: Nov. 11, 2009

(86) PCT No.: PCT/JP2009/069185

§ 371 (c)(1),
(2), (4) Date: Dec. 30, 2010

(87) PCT Pub. No.: WO2010/055846

PCT Pub. Date: May 20, 2010

(65) Prior Publication Data

US 2011/0209620 A1 Sep. 1, 2011

(30) Foreign Application Priority Data

Nov. 14, 2008 (JP) ..... 2008-292067

(51) Int. Cl.
*B03C 3/45* (2006.01)

(52) U.S. Cl.
USPC ..... 96/62; 96/66; 96/96; 96/98

(58) Field of Classification Search
USPC ..... 96/60, 62, 66, 70, 96–98, 100
See application file for complete search history.

(56) References Cited

U.S. PATENT DOCUMENTS

| | | | | |
|---|---|---|---|---|
| 3,910,779 | A * | 10/1975 | Penney | 96/66 |
| 3,966,435 | A * | 6/1976 | Penney | 96/66 |
| 2008/0250930 | A1 * | 10/2008 | Bologa et al. | 96/86 |

FOREIGN PATENT DOCUMENTS

| | | | | |
|---|---|---|---|---|
| GB | 2016305 | A * | 9/1979 | 96/96 |
| JP | 36-2293 | Y1 | 2/1961 | |
| JP | 53-78482 | A | 7/1978 | |
| JP | 2-63560 | A | 3/1990 | |
| JP | 7-155641 | A | 6/1995 | |
| JP | 2000-279848 | A | 10/2000 | |
| JP | 2003-340316 | A | 12/2003 | |
| JP | 2004-160286 | A | 6/2004 | |
| JP | 2007-100635 | A | 4/2007 | |

OTHER PUBLICATIONS

Notification of Transmittal of Translation of the International Preliminary Report on Patentability (Form PCT/IB/338), International Preliminary Report on Patentability (Form PCT/IB/373), and Written Opinion of the International Searching Authority (Form PCT/ISA/237), dated Jun. 30, 2011, from the corresponding International Application No. PCT/JP2009/069185).

* cited by examiner

*Primary Examiner* — Richard L Chiesa
(74) *Attorney, Agent, or Firm* — Young Basile

(57) ABSTRACT

An object of the present invention is to provide an electric dust collector with its dust collecting performance being improved for collecting dust-like particles contained in a gas, whereas the increase in size thereof is being suppressed. An electric dust collector distributes a gas that has flown into a distribution chamber to a plurality of charging flow paths in a casing thereof, causes the distributed gas to flow from the insides of the charging flow paths into internal flow paths through mesh filters that are formed as parts of the dust collecting electrodes and that have a large surface areas per unit volume. Then, the gas is discharged to a central chamber through internal outlets. Subsequently, the flow of the gas is controlled to be discharged to the outside through a gas outlet.

2 Claims, 8 Drawing Sheets

ELECTRIC DUST COLLECTOR

TECHNICAL FIELD

The present invention relates to electric dust collectors that purify gases containing dust-like particles, such as soot discharged from industrial apparatuses, such as incinerators, melting furnaces, power boilers, metal melting furnaces, and the like.

BACKGROUND

In industrial apparatuses, such as incinerators, melting furnaces, power boilers, metal melting furnaces, and the like, hot exhaust gases (hereinafter simply referred to as "gases") that contain dust-like particles, such as soot are generated in connection with combustion reaction, thermal reaction, or the like at the time of its operation. Then, these gases are discharged to the outside. The gases discharged from the industrial apparatuses are sent to a filter-type dust collector or electric dust collector after cooled to a certain degree of temperature, and the dust-like particles are collected and removed by such a dust collector.

When the filter-type dust collectors and the electric dust collectors are compared with each other, the filter-type dust collectors using bag filters are generally considered superior in dust collecting performance for collecting dust-like particles being dispersed in gases. When temperatures of the gases are high, however, the electric dust collectors are used to collect and remove the dust-like particles with electrostatic forces (collecting ability) since the bag filters cannot be used.

As an above-described electric dust collector, as shown in FIG. 8, there is an electric dust collector provided with: a hollow casing 100 at which a gas inlet 102 and a gas outlet 104 are formed, respectively; discharge electrodes 106 and dust collecting electrodes 108 that are arranged in this casing 100, respectively; and a high-voltage power supply (not shown) that is connected to the discharge electrodes 106 and that applies a driving voltage between these discharge electrodes 106 and dust collecting electrodes 108. In this electric dust collector, as shown in FIG. 8, charges are given to dust-like particles contained in a gas G by corona discharge from the discharge electrodes 106 and then the dust-like particles are electrically charged, while flowing the gas G containing the dust-like particles between the discharge electrodes 106 and the dust collecting electrodes 108. Thereby, these dust-like particles are attracted to the dust collecting electrodes 108 with an electrostatic force, and are then adsorbed.

In addition, an electric dust collector described in, for example, Patent document 1 is known. This electric dust collector described in JP 2004-160286 A (herein "Patent Document 1") is provided with: a first dust collecting portion on an upstream side in a casing in a flow direction of a gas; and a second dust collecting portion on a downstream side of the first dust collecting portion.

Specifically, a plurality of plate-shape dust collecting electrodes are arranged at the first dust collecting portion and a plurality of rod-shape discharge electrodes are disposed between a pair of dust collecting electrodes at a fixed interval over substantially an entire length in a longitudinal direction of the dust collecting electrodes. The second dust collecting portion is also formed to basically have a similar structure to the first dust collecting portion, and has a plurality of dust collecting electrodes and discharge electrodes, respectively. A high-voltage power supply is connected to the plurality of discharge electrodes in the first and second dust collecting portions, respectively.

In the electric dust collector described in Patent Document 1, the dust collecting electrodes each are formed into an elongated mesh plate in the flow direction of the gas, the discharge electrodes each are formed into an elongated rod that extends in a vertical direction substantially perpendicular to the flow direction of the gas, and are supported to oppose front surfaces or back surfaces of the dust collecting electrodes. Accordingly, what is disclosed is that the contact length of the dust collecting electrode and the gas can be made longer in the flow direction of the gas, and corona discharge can be made to act on the gas over the entire length of the dust collecting electrodes, thus enabling improvement in the dust collection efficiency of collecting the dust-like particles in the gas.

Patent Document 1 discloses that the discharge electrodes and the dust collecting electrodes are densely arranged at the second dust collecting portion on the downstream side, as compared with the discharge electrodes and dust collecting electrodes arranged at the first dust collecting portion on the upstream side. Therefore, even when a gas with a low concentration of dust-like particles is collected, the dust-like particles that fail to be collected at the first dust collecting portion on the upstream side can be collected efficiently at the second dust collecting portion on the downstream side.

It should be noted that, however, when the plurality of dust collecting portions are arranged as well as making the dust collecting electrodes to be elongated in the flow direction of the gas in order to extend the contact length of the dust collecting electrodes and the gas as described in the electric dust collector described in Patent Document 1, the size of the casing in the flow direction of the gas inevitably becomes longer. This may cause a disadvantage due to an installation space of the collector.

In addition, as described in Patent Document 1, when the discharge electrodes and the dust collecting electrodes are densely arranged at the second dust collecting portion on the downstream side as compared with the discharge electrodes and dust collecting electrodes arranged at the first dust collecting portion on the upstream side in order to efficiently collect the dust-like particles from the gas with the low concentration thereof, the dust collecting performance of the dust collecting portion on the upstream side is inferior to that of the dust collecting portion on the downstream side. Therefore, when a gas with a high concentration of dust-like particles is collected, it becomes difficult to keep an appropriate load balance between the dust collecting portion on the upstream side and the dust collecting portion on the downstream side. This may cause a problem that a dust collection efficiency of the collector is degraded.

In view of the above circumstances, an object of the present invention is to provide an electric dust collector that can efficiently improve the dust collecting performance of collecting dust-like particles contained in a gas, while the increase in size of the collector is being suppressed.

SUMMARY

According to an aspect of the present invention, there is provided an electric dust collector for collecting dust-like particles contained in gas with an electrostatic force, the electric dust collector comprising: a casing through which the gas flows; discharge electrodes arranged in the casing; dust collecting electrode arranged in the casing and formed into boxes with one end having an outlet, respectively, and having partition walls that partition inner and outer spaces and at least partially be made of metal mesh filter; and a voltage power applying unit for applying a driving voltage between the discharge electrodes and the dust collecting electrodes, wherein the dust collecting electrode controls a flow of the gas in the casing so that the gas is discharged to the outside of the dust collecting electrode through the outlet, after the gas to be collected in the casing flows into the dust collecting electrodes through the mesh filter.

In the above electric dust collector, the dust collecting electrodes control the flow of the gas in the casing so that the gas may be discharged to the outside through the outlets after the gas targeted for dust collection flows into the inside of the dust collecting electrodes through the mesh filters in the casing. Accordingly, after the gas supplied in the casing flows into internal spaces from outer spaces of these dust collecting electrodes through the mesh filters that are formed as parts of the dust collecting electrodes and that have large surface areas per unit volume, it can be discharged to the outside of the collector. Therefore, even though sizes of the dust collecting electrodes and the casing are not increased in a specific direction, a contact area can be efficiently increased between the gas including the dust-like particles charged by corona discharge from the discharge electrodes and the dust collecting electrodes.

In addition, for example, if fineness of meshes (the number of meshes) of the mesh filters and texture of the meshes are arbitrarily selected depending on the concentration and the particle diameter distribution of the dust-like particles in the gas, the dust-like particles contained in the gas can be collected and removed by filtration of the mesh filters themselves in addition to electrostatic adsorption power, and thus the dust collection efficiency of the collector can be improved as a whole, when performing dust collecting treatment on a gas with a high content rate of dust-like particles. Consequently, with the above electric dust collector, dust collecting performance for collecting dust-like particles contained in a gas can be efficiently improved while suppressing the increase in size of the collector.

In addition, in the above electric dust collector, the discharge electrode is arranged to be opposed to the mesh filter and to extend in a flow direction of the gas that flows between the discharge electrode and the mesh filter, a plurality of discharge wire support portions that support discharge wires are arranged at the discharge electrodes, respectively, in the flow direction of the gas, and the number of the discharge wires arranged at the plurality of discharge wire support portions, respectively, is gradually decreased from the discharge wire support portion located on an upstream side in the flow direction of the gas toward the discharge wire support portions located on a downstream side in the flow direction of the gas.

In addition, in the above electric dust collector, the dust collecting electrode is formed by integrally assembling a plurality of electrode units each having an outlet and a mesh filter, and is capable of being disassembled into the plurality of electrode units.

With the electric dust collector according to the present invention described above, dust collecting performance for collecting dust-like particles contained in a gas can be efficiently improved while suppressing the increase in size of the collector.

BRIEF DESCRIPTION OF DRAWINGS

The description herein makes reference to the accompanying drawings wherein like reference numerals refer to like parts throughout the several views, and wherein.

DESCRIPTION OF EMBODIMENTS

Hereinafter, an electric dust collector according to an embodiment of the present invention will be described with reference to the accompanying drawings.

Figure 1:
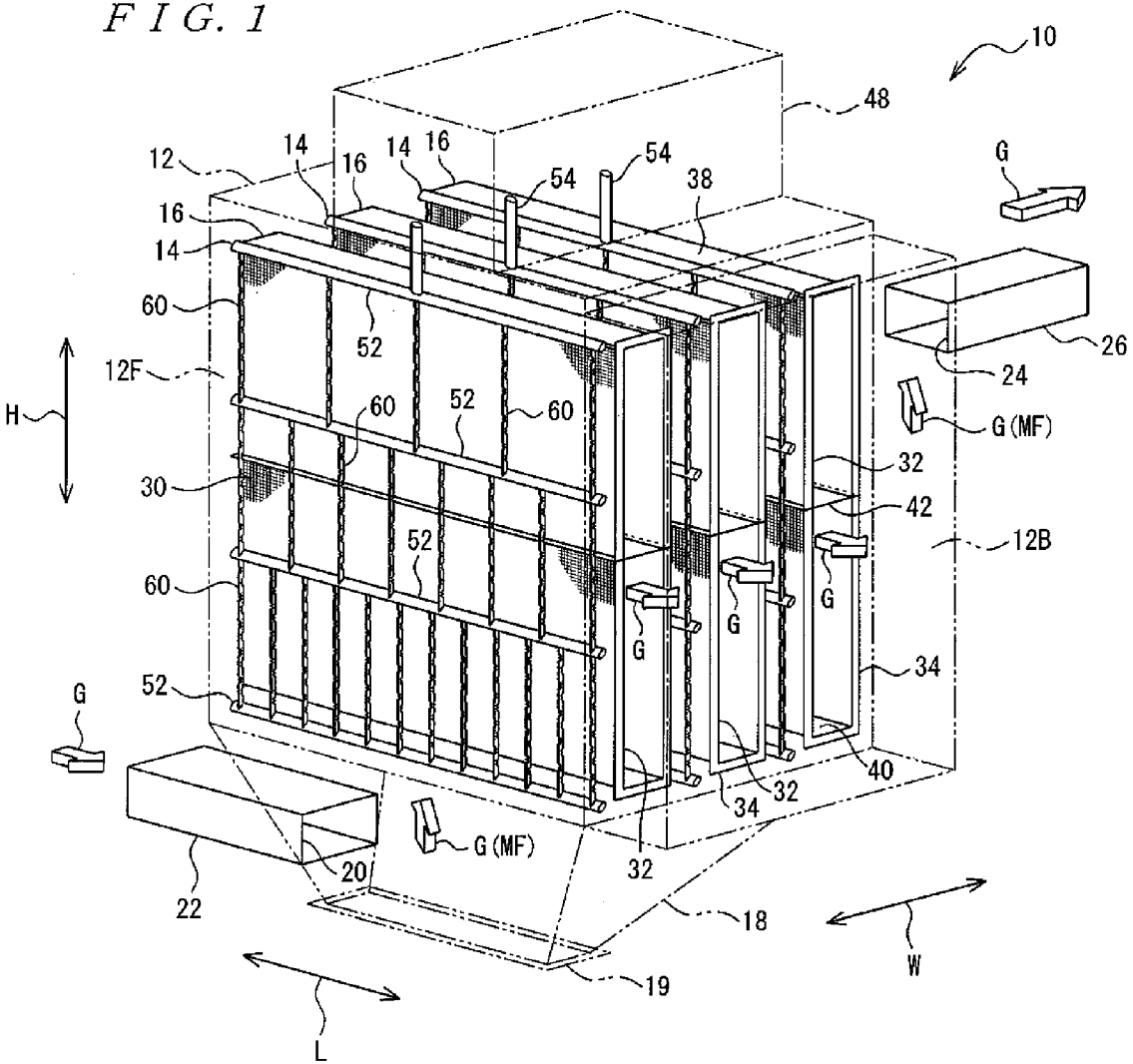
FIG. 1 is a perspective view showing a configuration of an electric dust collector according to an embodiment of the present invention.
Figure 2:
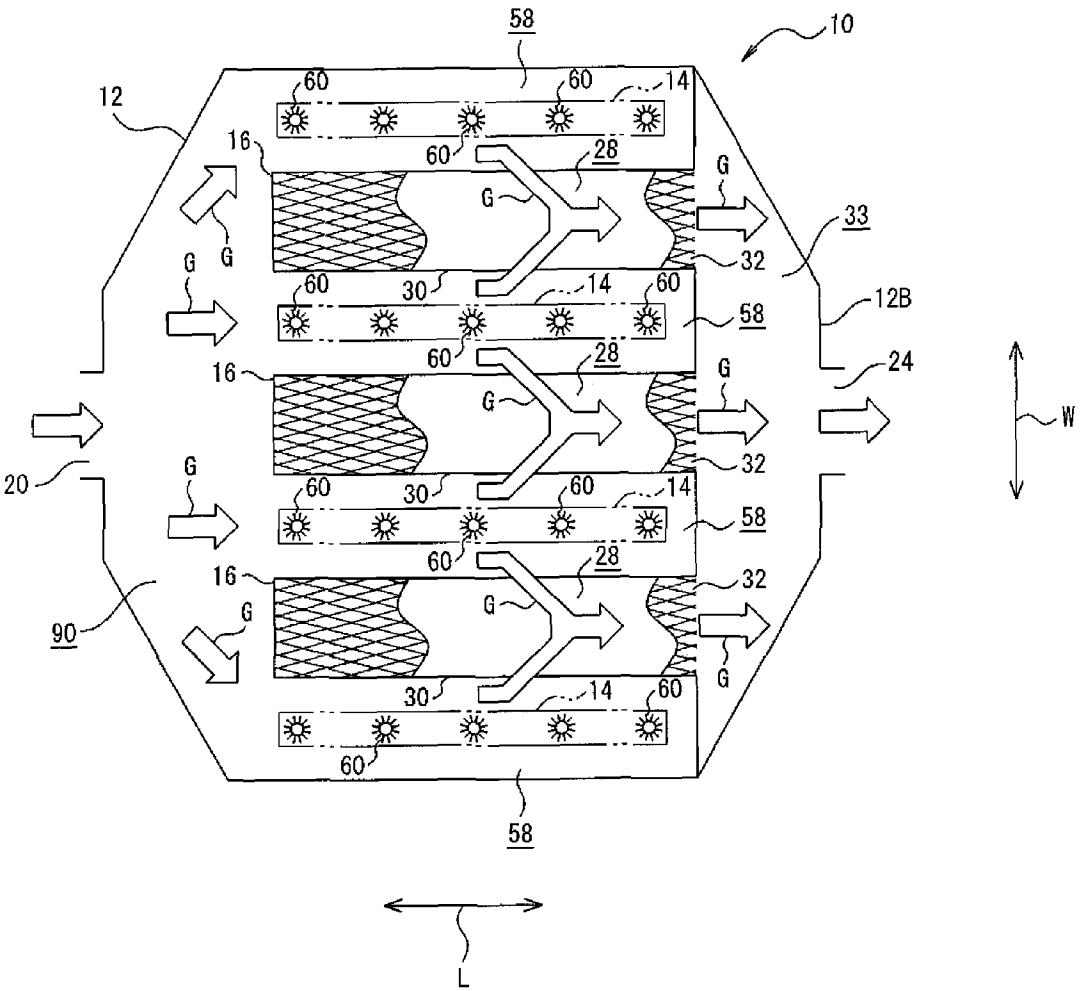
FIG. 2 is a plan view schematically showing the configuration of the electric dust collector shown in FIG. 1.

FIG. 1 and FIG. 2 illustrate a configuration of the electric dust collector according to an embodiment of the present invention. An electric dust collector 10 is provided with a hollow casing 12 formed to have a substantially rectangular parallelepiped shape, and discharge electrodes 14 and dust collecting electrodes 16 are arranged in the casing 12. As illustrated in FIG. 1, a bottom plate of the casing 12 is provided with a funnel-shape hopper 18 protruding downward. A cross-sectional area of the hopper 18 is gradually reduced from an upper end side toward a lower end side, and the hopper 18 is formed into a square tube so as to penetrate in a height direction (in the direction of an arrow H) of the collector. Accordingly, dust-like particles collected in the electric dust collector 10 can be stored in a lower portion of the hopper 18.

A flange member 19 that can be opened and closed from outside is arranged at a lower end of the hopper 18. A discharger for discharging the collected and stored dust-like particles out of a system (for example, a screw conveyor or a rotary valve) is attached to the lower end of the hopper 18 through the flange member 19. In addition, a gas inlet 20 is opened on a side plate, located at one side (left side in FIG. 1), of the hopper 18 in a longitudinal direction (in the direction of an arrow L) of the collector. A tip of an introduction duct 22 that constitutes a flow path of a gas G is connected to this gas inlet 20.

Specifically, a base end of the introduction duct 22 is connected to an outlet of an industrial apparatus (not shown) in which combustion treatment and heat treatment are performed, while the introduction duct 22 is sucking a gas containing dust-like particles discharged from an incinerator, a melting furnace, a power boiler, a metal melting furnace, or the like. The gas G discharged from this outlet generally contains dust-like particles P (see FIG. 7), such as soot and dirt, which are sent into the vicinity of a bottom in the casing 12 through the introduction duct 22 and the gas inlet 20. However, a shape and an attachment position of the introduction duct 22 may be changed depending on a shape and arrangement of the outlet of the industrial apparatus located at a preceding stage of the electric dust collector 10.

It is to be noted that when a temperature of the gas G discharged from the outlet of the industrial apparatus is very high, for example, after the gas G is cooled down to not more than a tolerable temperature of the electric dust collector 10 with a gas cooling apparatus provided in the middle of the introduction duct 22, this gas G is sent into the casing 12.

As illustrated in FIG. 1, a gas outlet 24 is opened on a back plate 12B in the casing 12, the back plate being located at the other end side (far side in FIG. 1) in a width direction (in the direction of an arrow W) of the collector. This gas outlet 24 is opened near an upper end of the back plate 12B and also near an end opposite to the gas inlet 20 in the longitudinal direction L, that is, near a corner of the back plate 12B opposite to the gas inlet 20. A base end of a discharge duct 26 that constitutes the flow path of the gas G is connected to the gas outlet 24. As will be described later, the gas G on which dust collecting treatment has been performed in the casing 12 is sent to a treatment apparatus that performs another treatment on the gas G as necessary through the gas outlet 24 and the discharge duct 26, or is discharged into the atmosphere. However, a shape and an attachment position of the gas outlet 24 may be changed depending on the shape and arrangement of the inlet of the treatment apparatus located at the subsequent stage of the electric dust collector 10.

In addition, an induced fan (not shown) is arranged in the middle of the discharge duct 26. The induced fan sucks the gas G from a space (flow path) on the casing 12 side in the discharge duct 26. Accordingly, inside the casing 12 is formed a gas flow (main flow MF (see FIG. 1)) into which the gas G flows from the gas inlet 20 of the casing 12 toward the gas outlet 24 thereof as a whole.

Figure 5:
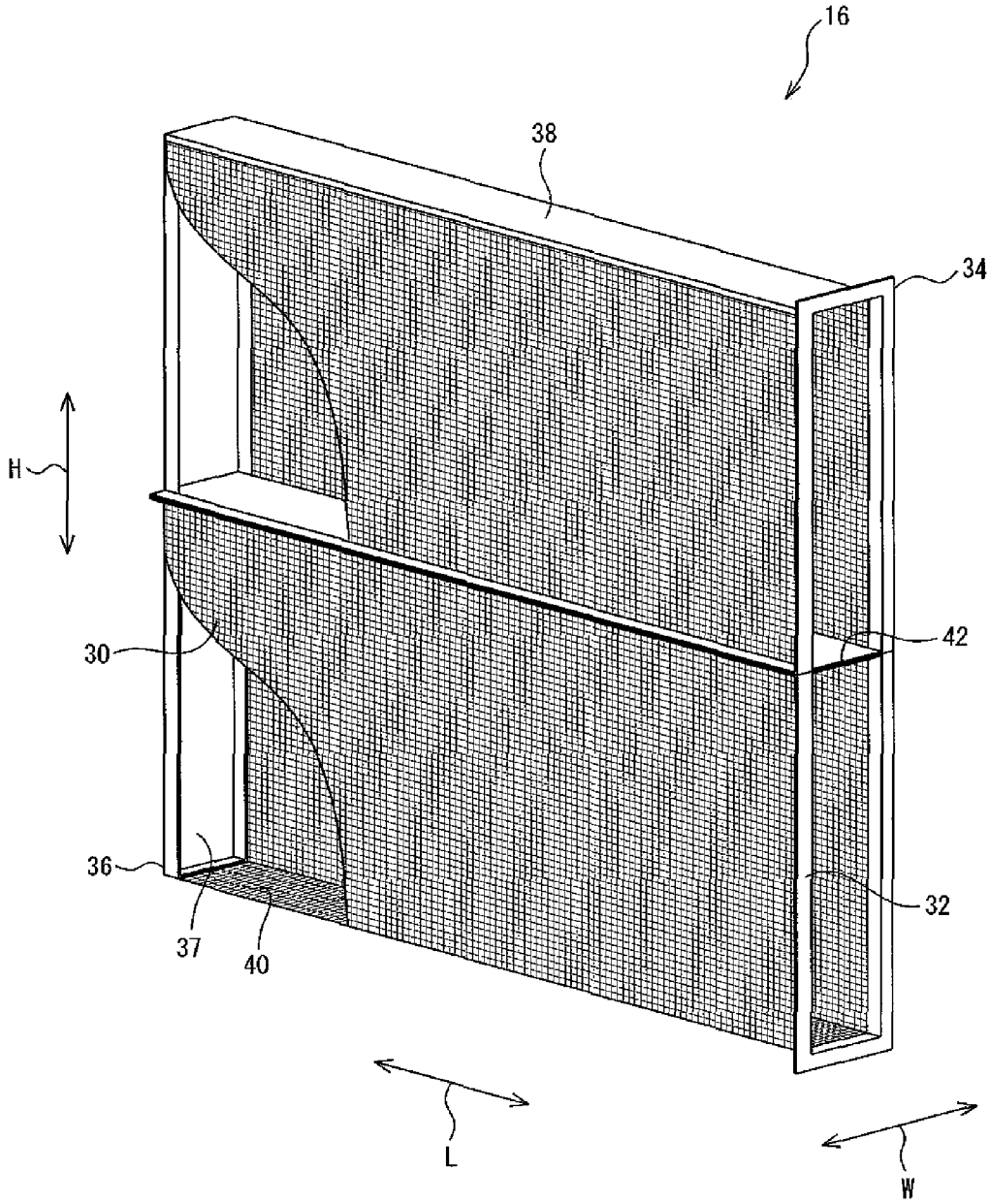
FIG. 5 is a perspective view showing the configuration of the dust collecting electrodes in the electric dust collector shown in FIG. 1.

A plurality of (three in the present embodiment) dust collecting electrodes 16 arranged in the casing 12 each have outer shapes are formed into thick plates, respectively, and insides thereof are made hollow. The dust collecting electrodes 16 are supported by the casing 12 through brackets so that a thickness direction thereof may coincide with the width direction W. Referring to FIG. 2, internal spaces of the dust collecting electrodes 16 are each formed to be internal flow paths 28 where the gas G flows after having passed through mesh filters 30, to be described later. Referring to FIG. 5, substantially a whole side end surface of one side of the dust collecting electrode 16 is opened in the longitudinal direction L. This opening is formed as an internal outlet 32 that discharges the gas G having flowed in the internal flow path 28 into the casing 12. As shown in FIG. 2, a central chamber 33 of the gas G is formed at an end on the gas outlet 24 side in the casing 12 in the longitudinal direction L, and the gases G discharged from the internal outlets 32 of the a plurality of dust collecting electrodes 16 respectively flow into this central chamber 33 to get together.

As shown in FIG. 5, a support frame 34 and a support frame 36 are arranged at both ends of the dust collecting electrode 16 in the longitudinal direction L, respectively. The support frame 34 is formed into a frame with a shaped steel, and the above-mentioned internal outlet 32 is formed in the support frame 34. The support frame 36 is formed into an elongated frame in a height direction H, and a side end surface opposite to the internal outlet 32 of the dust collecting electrode 16 is closed by a back plate 37.

As shown in FIG. 5, the dust collecting electrode 16 is provided with an upper closing plate 38 bridged between an upper end of the support frame 34 and that of the support frame 36, and a lower closing plate 40 bridged between a lower end of the support frame 34 and that of the support frame 36. These upper closing plate 38 and lower closing plate 40 connect the support frame 34 and the support frame 36 with each other. In addition, the dust collecting electrode 16 is provided therein with a partition wall 42 that partitions the internal flow path 28 into an upstream portion 44 of a lower end side and a downstream portion 46 of the upper end side in the height direction H (see FIG. 4).

As shown in FIG. 5, the mesh filter 30 is arranged between the support frame 34 and the support frame 36 in the dust collecting electrode 16. This mesh filter 30 is formed into a net-shape body by knitting a fiber-like material, a wire-like material, or the like made of a conductive metal. The mesh filter 30 is composed of a plurality of split pieces formed in planes, respectively, and these split pieces are attached to a plurality of frame members (not shown) formed into frames with a shaped steel, respectively, and are connected and fixed to the support frames 34 and 36 through the plurality of frame members. In this situation, a top surface and a bottom surface of the dust collecting electrode 16 are made to be in a closed state by using the upper closing plate 38 and the lower closing plate 40, respectively so as not to allow the gas G to be flown into.

Fineness of the meshes (the number of meshes) of the mesh filter 30 is arbitrarily set depending on a flow amount of the gas G per unit time, the number of dust-like particles P (see FIG. 7) contained in the gas G per unit volume, an average particle diameter and a particle diameter distribution of the dust-like particles P, or the like. Here, although the dust collection efficiency of the mesh filter 30 for collecting the dust-like particles P is generally higher in a case of finer meshes (a large number of meshes), clogging easily occurs and a time period until the clogging occurs also becomes shorter. Therefore, it is necessary to properly set the number of the meshes in consideration of the balance between finer meshes and occurrence of clogging.

In addition, also as for texture of the mesh filter 30, when the number of meshes is fixed, the dust collection efficiency for collecting the dust-like particles P is generally higher in a case of stereoscopic texture such as "tatami" texture than in a case of a usual plain texture. However, removing operations of the dust-like particles P become more complicated and the cost of the parts becomes higher as well, thus making it necessary to properly set the texture of the mesh filter 30 in consideration of the balance between the operations and the cost. It is to be noted that the mesh filter 30 with a laminated structure in which the same number of the meshes or a different number of the meshes are laminated may be used.

As shown in FIG. 2, the plurality of dust collecting electrodes 16 are arranged at equal intervals in the longitudinal direction L, and spaces extending in the width direction W are formed between a pair of dust collecting electrodes 16 adjacent to each other. These spaces are utilized as charging flow paths 58 for giving charge to the dust-like particles P in the gas G by the discharge electrodes 14, as will be described later. In addition, the charging flow paths 58 extending in the longitudinal direction L are also formed between the dust collecting electrodes 16 and a front plate 12F of the casing 12, and between the dust collecting electrodes 16 and the back plate 12B of the casing 12, respectively. Here, the whole of the plurality of dust collecting electrodes 16 including the mesh filters 30 are in ground contact states, respectively.

Figure 3:
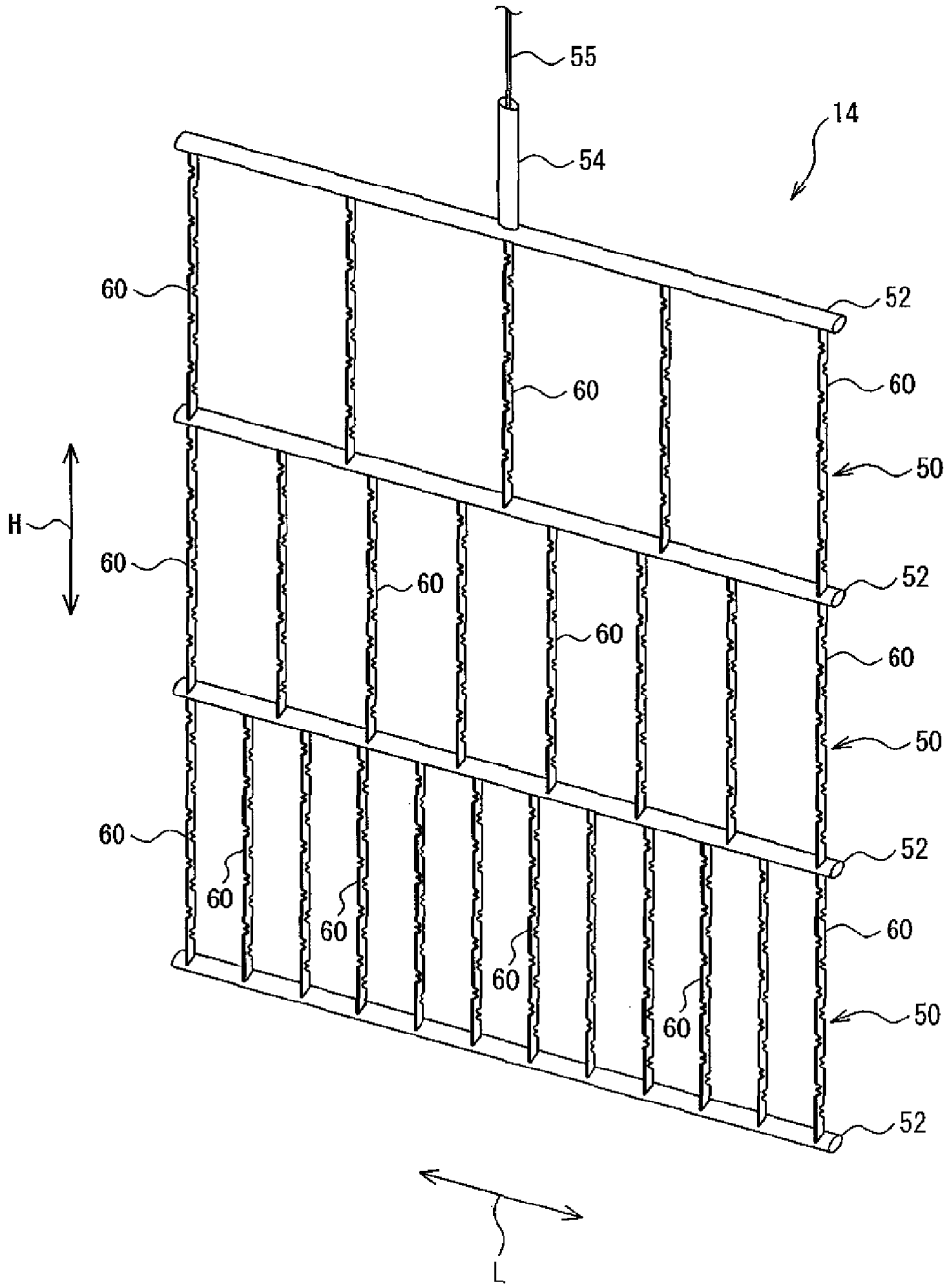
FIG. 3 is a perspective view showing a configuration of discharge electrodes in the electric dust collector shown in FIG. 1.

As shown in FIG. 1, in the casing 12, the discharge electrodes 14 are arranged between the pair of dust collecting electrodes 16 adjacent to each other in the width direction W, between the dust collecting electrodes 16 arranged at one end side and the front plate 12F, and between the dust collecting electrodes 16 arranged at the other end and the back plate 12B, respectively. The plurality of (four in the present embodiment) discharge electrodes 14 have ladder-shape structures as a whole as shown in FIG. 3, and they are arranged so as to be opposed to side surfaces of the mesh filters 30, respectively.

The discharge electrode 14 is supported so as to extend in the height direction H, and a plurality of (a plurality steps of) discharge wire support portions 50 are provided at this discharge electrode 14 in the height direction H. Discharge wires 60 and connecting members 52 are provided at the discharge wire support portions 50. The discharge wires 60 are formed of belt-shape conductive metals, and upper ends and lower ends thereof are connected to the connecting members 52 made of steel pipes, respectively. A high-voltage current flows in the discharge wires 60 of the respective discharge wire support portions 50 through the connecting members 52 at the discharge electrode 14.

Figure 7:
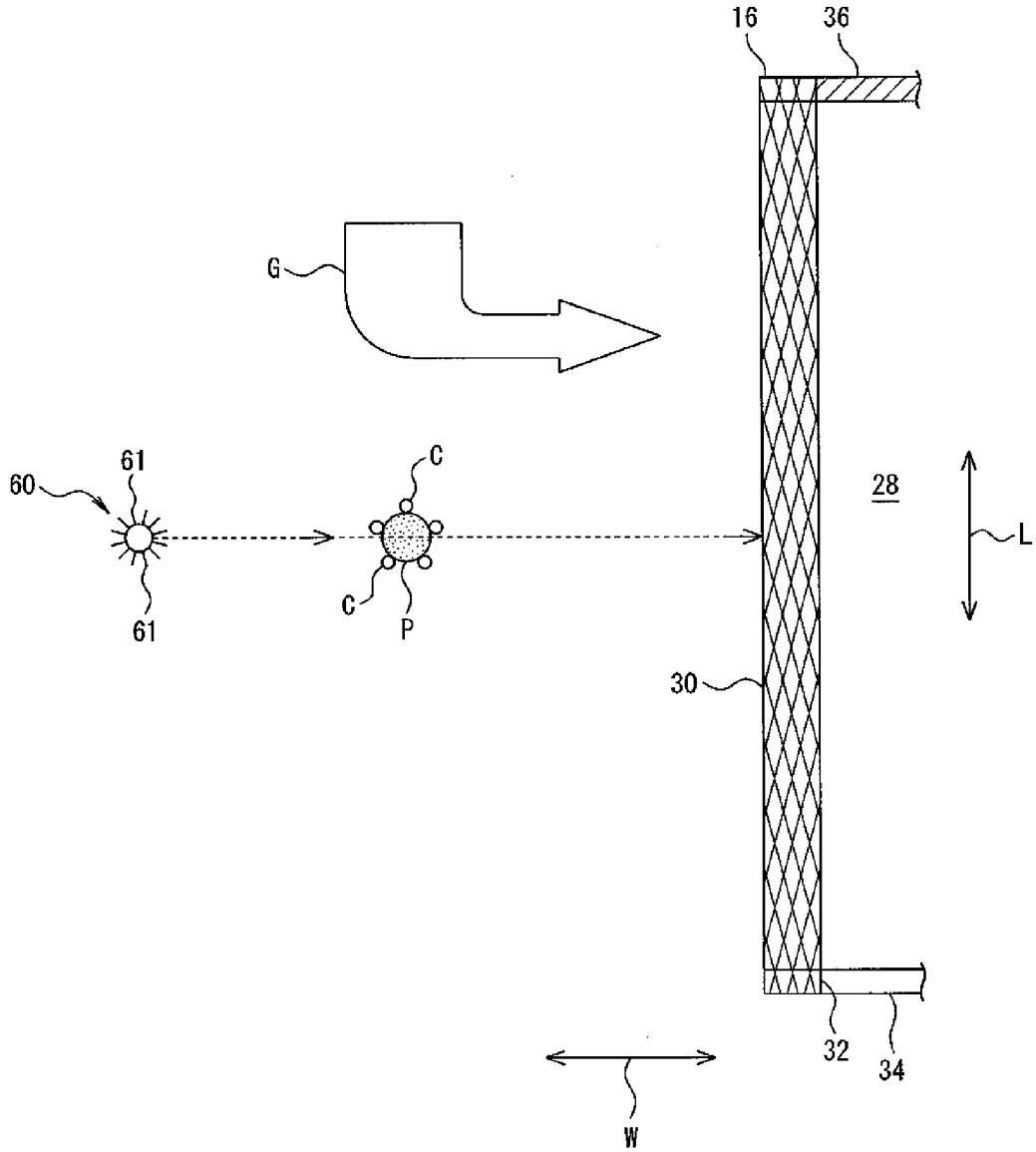
FIG. 7 is a plan view showing a discharge wire, a mesh filter, and a dust-like particle in the electric dust collector shown in FIG. 1.
Figure 8:
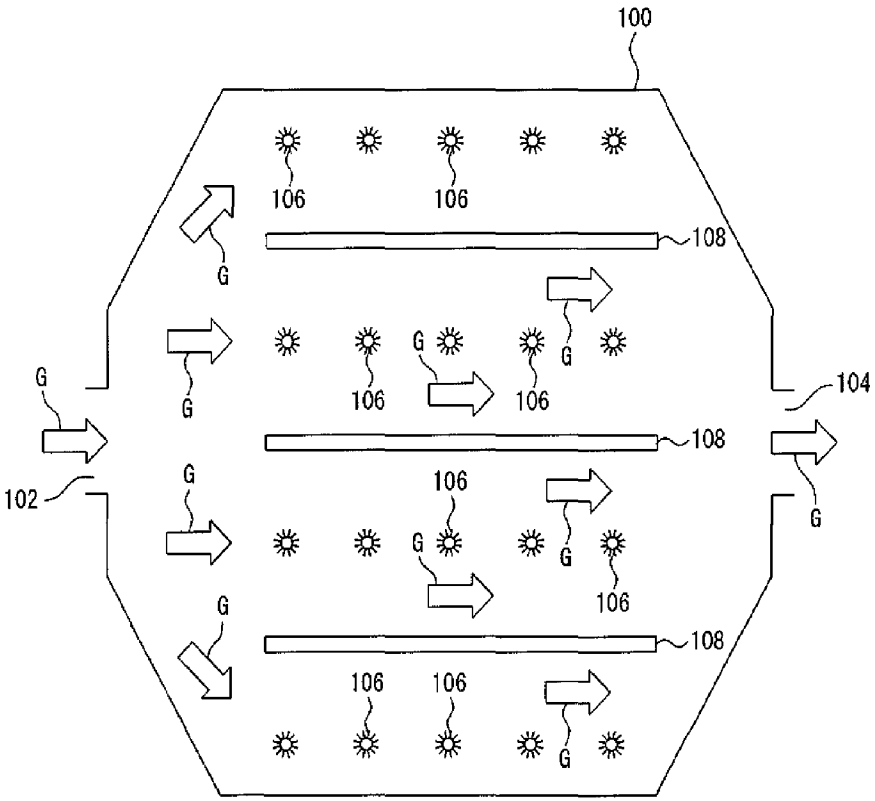
F I G. 8 PRIOR ART
FIG. 8 is a plan view schematically showing a configuration of a conventional electric dust collector.

The connecting members 52 extend in parallel with the longitudinal direction L, and the discharge wires 60 extend in parallel with the height direction H. It is to be noted that the discharge wires 60 have projections or points, and a number of discharge projections 61 are radially formed thereon as illustrated in FIG. 7. As a result of this, when a driving voltage is applied by a high-voltage power supply, it is easy to generate corona discharge from tips of the discharge projections 61.

As shown in FIG. 1, a box-shape housing 48 is integrally formed at a center of a top plate of the casing 12 in the longitudinal direction L, and this housing 48 houses: a member for conducting a voltage from a driving voltage generator (not shown) to the discharge electrodes 14; an insulator (not shown) for insulating them from the casing; and the like. Meanwhile, a hanging pipe 54 is connected to a center of the uppermost connecting member 52 of the discharge electrode 14 in the longitudinal direction L as shown in FIG. 3. The hanging pipe 54 is formed of an insulating material, but has a sufficiently high tensile strength due to the necessity of supporting the whole weight of the discharge electrode 14. In addition, another connecting member 52 is connected to the lowermost connecting member 52, and the discharge electrode 14 is prevented from vibrating or swaying in the width direction W and the longitudinal direction L by being connected to the other discharge electrode 14.

An upper end of the hanging pipe 54 is connected and fixed to a feed member in the housing 48. This feed member is supported by an insulating glass (not shown), and hangs the discharge electrode 14. In addition, a high-voltage cable for supplying a driving voltage (not shown) is connected to the feed member in the housing 48, and this high-voltage cable feeds power to the whole discharge electrode 14 through the hanging pipe 54.

The discharge wires 60 are arranged at equal intervals in the longitudinal direction of the connecting pipes 52 at each discharge wire support portion 50 of the discharge electrode 14. In addition, in the discharge electrode 14, the number of discharge wires 60 arranged at each discharge wire support portion 50 gradually increases from the discharge wire support portion 50 located at an upper side in the height direction H toward the discharge wire support portion 50 located at a lower side. Specifically, in the present embodiment, three stages of discharge wire support portions 50 are provided at the discharge electrode 14, five discharge wires 60 are arranged at the discharge wire support portion 50 in the upper stage, eight discharge wires 60 are arranged at the discharge wire support portion 50 in the middle stage, and twelve discharge wires 60 are arranged at the discharge wire support portion 50 in the lower stage.

However, the number of the stages of the discharge wire support portions 50 provided at the discharge electrode 14 and the number of discharge wires 60 arranged at each discharge wire support portion 50 are not limited to those described in the present embodiment.

Figure 4:
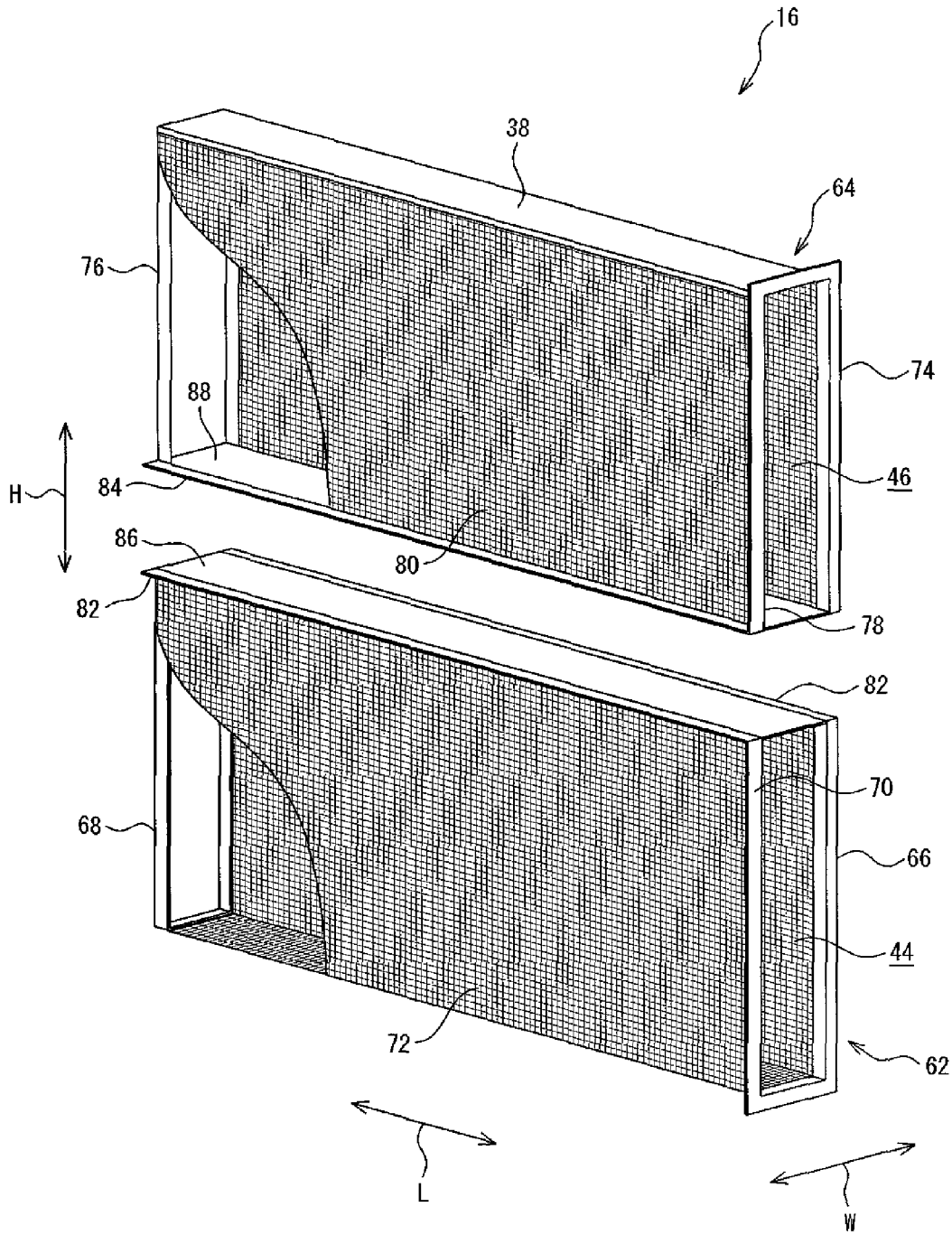
FIG. 4 is a perspective view showing a configuration of dust collecting electrodes in the electric dust collector shown in FIG. 1, and shows a state where the dust collecting electrodes have been disassembled into electrode units.

The dust collecting electrode 16 is provided with a plurality of (two in the present embodiment) electrode units 62 and 64 as illustrated in FIG. 4, and the two electrode units 62 and 64 are integrally assembled as illustrated in FIG. 5. One electrode unit 62 corresponds to a lower end side of the dust collecting electrode 16 through the partition wall 42 (refer to FIG. 5), and the upstream portion 44 that corresponds to a part of the internal flow path 28 is arranged therein. In addition, the electrode unit 64 corresponds to an upper end side of the dust collecting electrode 16 through the partition wall 42, and the downstream portion 46 that corresponds to a part of a rest of the internal flow path 28 is arranged therein.

At the electrode unit 62 are provided lower frames 66 and 68 that correspond to lower end sides of the support frames 34 and 36 of the electrode unit 62, respectively, and a lower filter 72 that corresponds to a lower end side of the mesh filter 30. Here, a lower opening 70 that corresponds to a part of the internal outlet 32 is arranged at the lower frame 66.

At an upper end of the electrode unit 62 are arranged flanges 82 extending outside from both ends in the longitudinal direction L, respectively, and between this pair of flanges 82 arranged is a divider plate 86 that closes an upper end side of the upstream portion 44 in the internal flow path 28. In addition, at a lower end of the electrode unit 64 arranged are a pair of flanges 84 that corresponds to the pair of flanges 84 of the electrode unit 62, respectively, and also between this pair of flanges 82 is arranged a divider plate 88 that closes a lower end side of the downstream portion 46 in the internal flow path 28.

When assembling the two electrode units 62 and 64 to be the dust collecting electrode 16, the flanges 82 and the divider plate 86 of the electrode unit 62 are firmly made to contact the flanges 84 and the divider plate 88 of the electrode unit 64, respectively. Then, bolts are inserted into insertion holes (not shown) bored on the flanges 82 and 84, respectively. After that, nuts are screwed into tips of these bolts, whereby the electrode units 62 and 64 are assembled to be the dust collecting electrode 16. In this process, the divider plate 86 and the divider plate 88 constitute the partition wall 42 (refer to FIG. 5) that partitions the internal flow path 28 into the upstream portion 44 and the downstream portion 46.

In addition, when the dust collecting electrode 16 is disassembled into the two electrode units 62 and 64, it becomes possible to disassemble the dust collecting electrode 16 into the electrode units 62 and 64 by removing the bolts and the nuts from the flanges 82 of the electrode unit 62 and from the flanges 84 of the electrode unit 64.

Next will be described a dust collecting treatment of collecting the gas G by using the electric dust collector 10 configured as described above. When an industrial apparatus, such as an incinerator, a melting furnace, a power boiler, a metal melting furnace or the like, is operated, the electric dust collector 10 actuates the induced fan (not shown) arranged in the pathway of the discharge duct 26. This causes the introduction duct 22 that is a space of an industrial apparatus side with respect to the induced fan, an inside of the casing 12, and an upstream side of the discharge duct 26 to become in a negative pressure state, and the gas G containing the dust-like particles P generated from the industrial apparatus is guided to enter the casing 12 through the introduction duct 22 and the gas inlet 20.

In this situation, among spaces in the casing 12, an inner portion of the hopper 18 is used as a distribution chamber 90 of the gas G that flowed has flown into the casing 12 from the gas inlet 20 as shown in FIG. 2, and the gas G that has flown into this distribution chamber 90 is distributed to flow into the plurality of (four in the present embodiment) charging flow paths 58, respectively.

Figure 6:
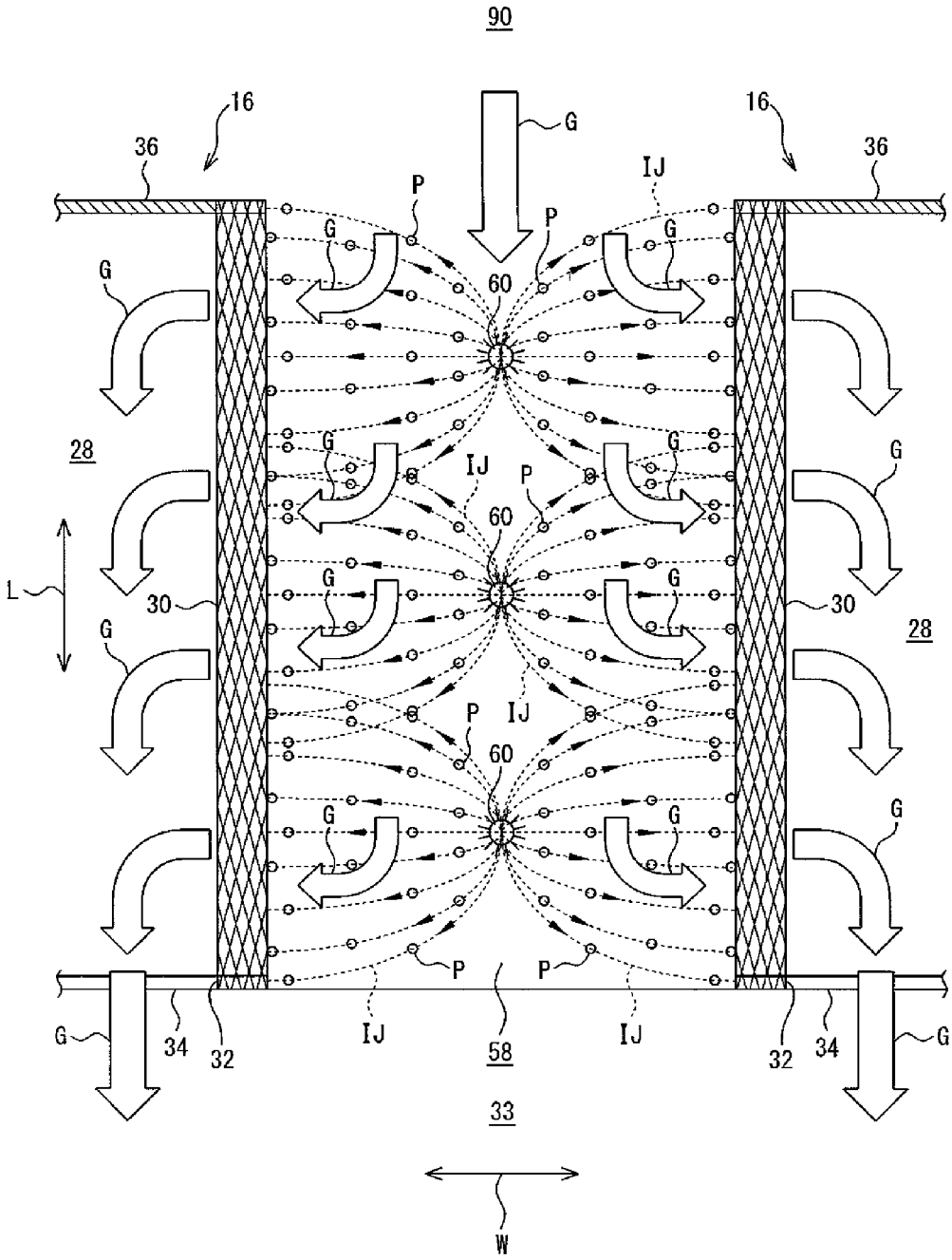
FIG. 6 is a plan view showing charged flow paths, the dust collecting electrodes, and flows of a gas in the electric dust collector shown in FIG. 1.

The gas G that has flown into the charging flow paths 58 becomes an upward flow flowing from lower ends (opening ends) toward upper ends (closed ends) of the charging flow paths 58 as a whole due to an effect of a negative pressure generated from the induced fan. However, the discharge wires 60 of the discharge electrodes 14 are arranged in the charging flow paths 58, respectively, and the driving voltage is applied to the discharge wires 60 by the high-voltage power supply (not shown). As a result of this, in the charging flow paths 58, due to an effect of corona discharge generated from the discharge wires 60, ion streams IJ (see FIG. 6) that flow from these discharge wires 60 to mesh filter 30 sides of the dust collecting electrodes 16 are generated. In addition, charges C are given to the dust-like particles P contained in the gas G, and the particles are charged to have predetermined polarities as shown in FIG. 7. Hence, the gas G and the dust-like particles P that flow in the charging flow paths 58 gradually flow to enter the mesh filters 30 with air permeability while flowing from the lower end side toward the upper end side of the charging flow paths 58. The total amount of the gas G eventually passes through the mesh filter 30 to flow into the internal flow paths 28.

In this state, since the mesh filters 30 electrostatically exert the adsorption power on the dust-like particles P charged to be the predetermined polarities, the dust-like particles P in the gas G are adsorbed onto outer surfaces of the mesh filters 30 when the gas G passes through the mesh filters 30. Additionally, they are also trapped in minute gaps (inner surfaces) in the mesh filters 30 when the gas G passes through the mesh filters 30. Hence, the dust-like particles P contained in the gas G can be efficiently removed by using the mesh filters 30 when the gas G passes therethrough, whereas the gas G from which the dust-like particles P are removed and purified is sent into the internal flow paths 28 from the mesh filters 30.

The gas G sent into the internal flow paths 28 flows into the central chamber 33 through the internal outlets 32 of the dust collecting electrodes 16 as shown in FIG. 2. Since the gas outlet 24 is opened at an upper end of the central chamber 33, the gas G that has flown into the central chamber 33 from the internal outlets 32 of the plurality of dust collecting electrodes 16, respectively, is discharged to the outside of the casing 12 through the gas outlet 24. The gas G is then sent through the discharge duct 26 into an apparatus for performing another treatment on the gas G as required, or is discharged into the atmosphere without performing another treatment.

In the electric dust collector 10 according to the present embodiment as described heretofore, the gas G that has flown into the distribution chamber 90 in the casing 12 flows into the internal flow paths 28 through the mesh filters 30 of the dust collecting electrodes 16. Then, the flow of the gas G is controlled so that the gas G may be discharged to the central chamber 33 in the casing 12 through the internal outlets 32.

The above process distributes the gas G that has flown into the casing 12 to the plurality of charging flow paths 58, and the distributed gas G is flown into the internal flow paths 28 from insides of these charging flow paths 58 through the mesh filters 30 that are formed as parts of the dust collecting electrodes 16 and that have large surface areas per unit volume. Then, the gas G can be discharged to an outside of the collector through the internal outlets 32, the central chamber 33, and the gas outlet 24. Therefore, even though size of the dust collecting electrodes 16 and that of the casing 12 are not increased in a specific direction, a contact area can be efficiently increased between the gas G containing the dust-like particles P charged by corona discharge from the discharge electrodes 14 and the dust collecting electrodes 16 (mesh filters 30).

In addition, for example, if fineness of meshes (the number of meshes) of the mesh filters 30 and texture of the meshes are arbitrarily selected depending on a concentration and a particle diameter of the dust-like particles P in the gas G, the dust-like particles P contained in the gas G can be removed by filtration of the mesh filters 30 themselves in addition to electrostatic adsorption power. Thus, the dust collection efficiency of the collector as a whole can be improved when performing dust collecting treatment on the gas G with a high content rate of the dust-like particles P.

Hence, with the electric dust collector 10 according to the present embodiment, dust collecting performance of collecting the dust-like particles P contained in the gas G can be efficiently improved, with the increase in size of the collector including the casing 12 being suppressed.

In addition, in the electric dust collector 10, the gas G sent into the charging flow paths 58 from the distribution chamber 90 of the casing 12 moves to the mesh filters 30, and then passes through the mesh filters 30 to flow into the internal flow paths 28. In this process, a direction of an electrostatic force exerted on the dust-like particles P and a flow direction of the gas G substantially coincide with each other, thereby allowing the collection of dust at the mesh filters 30 reliably and efficiently.

In addition, in the electric dust collector 10, the discharge electrodes 14 are arranged at the charging flow paths 58 in the height direction H, and also the plurality of discharge wire support portions 50 are disposed at these discharge electrodes 14 in the height direction H. Furthermore, the number of the discharge wires 60 arranged at these discharge wire support portions 50, respectively, is gradually decreased from the discharge wire support portion 50 located at the lower end side toward the discharge wire support portion 50 located at the upper end side.

Accordingly, the amount of corona discharge generated from the discharge wires 60 is larger at the lower end side of the charging flow paths 58, and decreases gradually toward the upper end side. Therefore, the distribution of charge energy in the charging flow paths 58 is also higher at the lower end side, and gradually becomes lower toward the upper end side. Meanwhile, in the charging flow paths 58, the dust-like particles P contained in the gas G are gradually adsorbed and removed by the mesh filters 30, while the gas G flowing from the lower end side toward the upper end side as a whole, whereby the content rate of the dust-like particles P in the gas G is gradually reduced.

This results in the distribution of charge energy in the height direction H in the charging flow paths 58 that corresponds to the content rate of the dust-like particles P contained in the gas G, thereby preventing an excess corona discharge to be generated in a region with a low content rate of the dust-like particles P to consume an unnecessary electric power. This enables improvement in the utilization efficiency of electric power energy.

In addition, in the electric dust collector 10, the dust collecting electrode 16 is formed by integrally assembling a plurality of (two in the present embodiment) electrode units 62 and 64, and can also be disassembled into two electrode units 62 and 64.

Accordingly, for example, when the dust collecting electrode 16 is damaged due to corrosion, aged deterioration, and the like, and needs to be repaired, or when the inside of the casing 12 is cleaned or repaired, it is necessary to take out the dust collecting electrode 16 from the casing 12. However, the dust collecting electrode 16 can be disassembled into the plurality of electrode units 62 and 64 in the casing 12, and the electrode units 62 and 64 can be separately taken out from the casing 12. It is therefore possible to provide a take-out port (not shown) at the casing 12 to be made small, as compared with a case where the dust collecting electrode 16 are taken out from the casing 12 without change, that is without disassembling the dust collecting electrode 16. Additionally, the workload of a worker can be reduced at the time of taking out the dust collecting electrode 16 from the casing 12, and the workload can also be reduced at the time of attaching the dust collecting electrode 16 to the inside of the casing 12.

Accordingly, even though the dust collecting electrode 16 with a box structure whose bulk and weight tend to increase is used as described in the present embodiment, the work such as conveyance, removal from the casing 12, and attachment can be performed by dividing the dust collecting electrode 16 into the plurality of electrode units 62 and 64, thereby resulting in superior maintainability of the electric dust collector 10.

It is to be noted that the dust collecting electrode with a two-dividable structure composed of the electrode units 62 and 64 is used as the dust collecting electrode 16 in the electric dust collector 10 according to the present embodiment. However, it is also possible to use a dust collecting electrode that can be divided into three or more units.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. An electric dust collector for collecting dust particles contained in gas with an electrostatic force, the electric dust collector comprising:

a casing through which the gas flows;

discharge electrodes arranged in the casing;

a dust collecting electrode arranged in the casing between support frames provided at both ends in a longitudinal direction of the casing and formed into boxes with one end having an outlet, the dust collecting electrode at least partially made of metal mesh filter; and a voltage power applying unit for applying a driving voltage between the discharge electrodes and the dust collecting electrodes, wherein the dust collecting electrode controls a flow of the gas in the casing so that the gas is discharged to the outside of the dust collecting electrode through the outlet, after the gas to be collected in the casing flows into the dust collecting electrodes through the mesh filter, the discharge electrode is arranged to be opposed to the mesh filter and to extend in a flow direction of the gas that flows between the discharge electrode and the mesh filter, a plurality of discharge wire support portions that support discharge wires are arranged at the discharge electrodes, respectively, in the flow direction of the gas, and the number of the discharge wires arranged at the plurality of discharge wire support portions, respectively, is gradually decreased from the discharge wire support portion located on an upstream side in the flow direction of the gas toward the discharge wire support portions located on a downstream side in the flow direction of the gas.

2. The electric dust collector according to claim 1, wherein the dust collecting electrode is formed by integrally assembling a plurality of electrode units each having an outlet and a mesh filter, and is capable of being disassembled into the plurality of electrode units.

* * * * *

UNITED STATES PATENT AND TRADEMARK OFFICE

CERTIFICATE OF CORRECTION

PATENT NO. : 8,574,353 B2
APPLICATION NO. : 13/002149
DATED : November 5, 2013
INVENTOR(S) : Taksuki Nazuka and Kazuhiro Suginami It is certified that error appears in the above-identified patent and that said Letters Patent is hereby corrected as shown below:

On the Title page column 1, item -- (73) Assignee: "Furukawa Industrial Machinery Systems Co., Ltd., Tokyo (JP)" should be -- Furukawa Industrial Machinery Systems Co., Ltd., Tokyo (JP); Taiheiyo Engineering Corporation, Tokyo (JP) --

Signed and Sealed this
Sixteenth Day of June, 2015

Michelle K. Lee

Michelle K. Lee
*Director of the United States Patent and Trademark Office*